United States Patent [19]

Hardwick et al.

[11] 4,034,426

[45] July 12, 1977

[54] BATH TUB LIFT CHAIR APPARATUS

[76] Inventors: Charles W. Hardwick, 600 W. 27th St., Sanford, Fla. 32771; Ann Hardwick Smith; Kinnaman Browning Smith, both of 702 Sargeant St., Waycross, Ga. 31501

[21] Appl. No.: 724,912

[22] Filed: Sept. 20, 1976

[51] Int. Cl.[2] ..... A47K 3/12

[52] U.S. Cl. ..... 4/185 L; 4/251

[58] Field of Search ..... 4/185 L, 185 R, 251, 4/185 AB; 297/DIG. 10; 5/51, 81 R, 86, 90

[56] References Cited

U.S. PATENT DOCUMENTS

| | | | |
|---|---|---|---|
| 1,934,117 | 11/1933 | Daley et al. | 4/185 L |
| 3,545,013 | 12/1970 | Discoe | 4/185 L |
| 3,624,666 | 11/1971 | Higgins | 4/185 L |
| 3,714,672 | 2/1973 | Condon | 4/185 L |
| 3,815,163 | 6/1974 | Sullivan | 4/185 L |
| 3,879,770 | 4/1975 | Grant | 4/185 L |
| 3,958,282 | 5/1976 | Crowe | 4/185 L |

*Primary Examiner*—Henry K. Artis

*Attorney, Agent, or Firm*—Duckworth, Hobby, Orman, Allen & Pettis

[57] ABSTRACT

An apparatus for raising and lowering invalids in a bath tub chair having a frame that fits into the bathtub with a chair rockably mounted to the frame. The frame has vertically extending gear racks while the rocking chair has a ratcheting gear attached thereto so that the rocking of the chair can be used to raise or lower the chair by its occupant.

13 Claims, 5 Drawing Figures

14
15
21
23
24
25
27
30
32
33
34
35
37
38
39
40
3

BATH TUB LIFT CHAIR APPARATUS

BACKGROUND OF THE INVENTION

The present invention relates to chairs for a bathtub and especially to chairs that allow an invalid to raise or lower himself for getting into or out of a bathtub, and especially to such a chair in which the invalid can raise or lower himself by the simple expedient of rocking the chair.

To the infirm or elderly, bathing can be a serious problem since it is often very difficult or impossible for such people to lift themselves into or out of a tub. Even with help the problem exists since manually lifting an adult into or out of a tub is a difficult procedure and the risk of injury to either party is great.

Mechanical lifting devices have been developed to aid invalids and elderly persons in getting into and out of a bathtub. Some of the prior devices have been unduly complicated and cumbersome. This adds to their expense and likelihood of break-down and may limit their use to institutions whereas many infirm or elderly have need for such lifting devices in their homes, which devices need to be sufficiently inexpensive that they can be afforded by the invalid or his family and can be easily placed in the bathtub for use by the invalid. Even though such a device should be sufficiently inexpensive, it must also be of sufficient rigid construction so that the users will not have a fear of the device falling or collapsing. Other bathtub lifting devices for invalids require operation by an assistant to the invalid thereby losing the advantage of the invalid being able to get himself into and out of the bathtub. Finally, it has been suggested for bathtubs to have incorporated therein invalid seats which can be raised or lowered by the operation of a valve which in turn operates a hydraulic cylinder, or the like, for raising or lowering the chair. This, however, requires complex plumbing in order to connect the lifting chair up to the water pressure lines and to the drain lines. In addition, these hydraulic type systems are usually expensive and require permanent installation either in a custom made bathtub or a substantially modified tub. This in turn requires replacement of the bathtub once the invalid has no further use for the seat. Other raising and lowering seats would be mounted like a crane with an overhead lift which tends to be cumbersome as well as give an insecure feeling to the invalid.

The present invention tends to overcome many of the problems of the prior art invalid chairs by providing a chair which can be inexpensively manufactured, easily and quickly placed in a bathtub and then removed if no longer needed. The present invention also provides for the invalid to be able to raise or lower himself in the seat along with handles to assist in getting into and out of the seat and tub.

Typical prior art systems for raising and lowering invalids can be seen in U.S. Pat. No. 3,545,013, to Discoe, for a hydraulic cylinder raising and lowering bathtub chair installed into a bathtub and in U.S. Pat. No. 3,256,036 for a lift device for bathtubs using hydraulic cylinders along with suction feet for holding the device in place in a bathtub. In U.S. Pat. No. 3,879,770, to Grant, another fluid operated bathtub lift is provided in which the lift is attached to the back of the bathtub for raising and lowering a seat while U.S. Pat. No. 3,624,666 teaches a device for assisting handicapped persons to get into and out of a bathtub having a rack and pinion system which is operated by an individual moving a lever back and forth to jack the invalid chair up or to lower the invalid chair. However, inasmuch as most invalids are in a weakened condition, they do not have sufficient arm and body strength for the continuous back and forth motion and effort required to jack the invalid chair both down into the tub and back up when the invalid has completed his bathing.

SUMMARY OF THE INVENTION

A bathtub lift chair for assisting invalid into and out of bathtubs has a frame with a supporting base and a rockable chair rockably mounted to said frame for rocking to and fro thereon. The rocking of the chair is used to raise or lower the rockable chair by the occupant of the chair so that an invalid can be lowered or raised in a bathtub. Vertically extending rack gears are attached to the frame and form a part thereof and are engaged by cog gears operated by a ratchet and pawl mechanism. Handles are provided to release the ratchet and pawl mechanism and to brake the chair in descent.

BRIEF DESCRIPTION OF THE DRAWINGS

Other objects, features and advantages of the present invention will be apparent from the written description and the drawings in which.

DESCRIPTION OF THE PREFERRED EMBODIMENT

Figure 1:
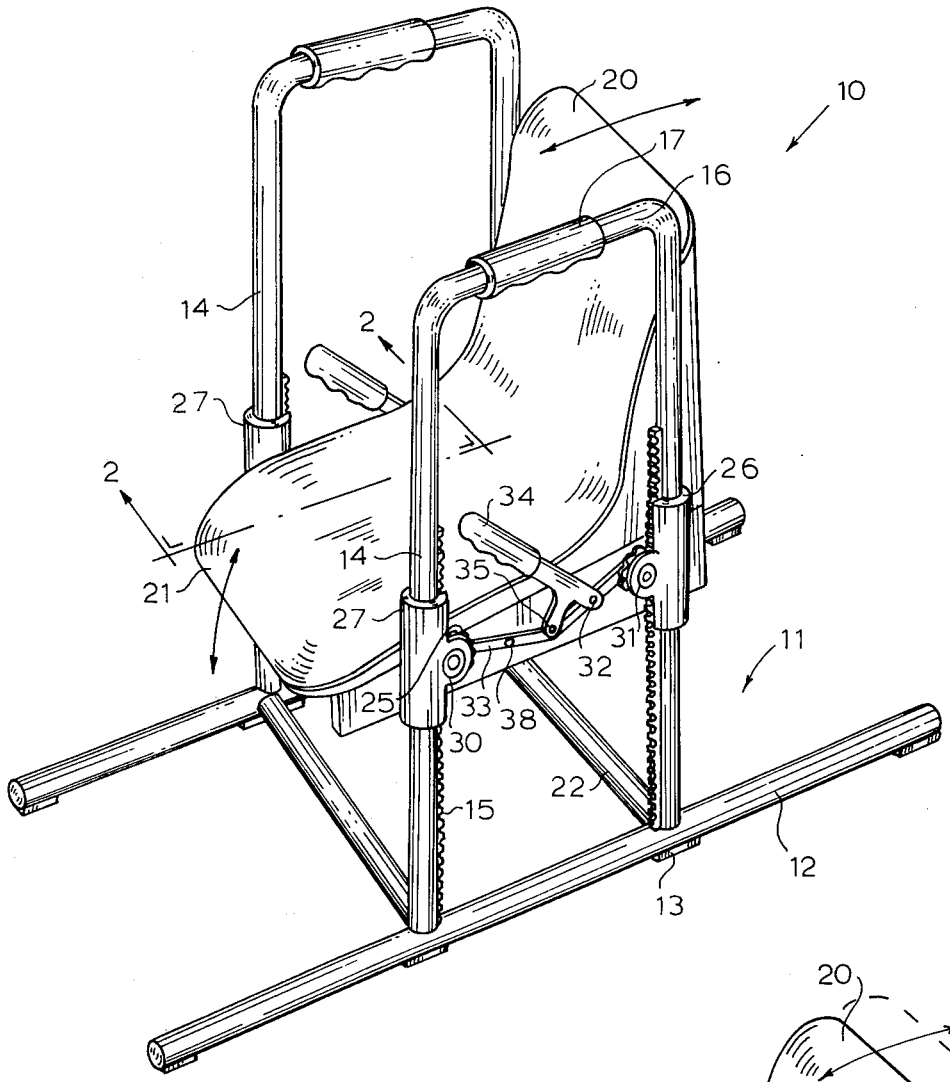
FIG. 1 is a perspective view of a bathtub lift chair for invalids.
Figure 5:
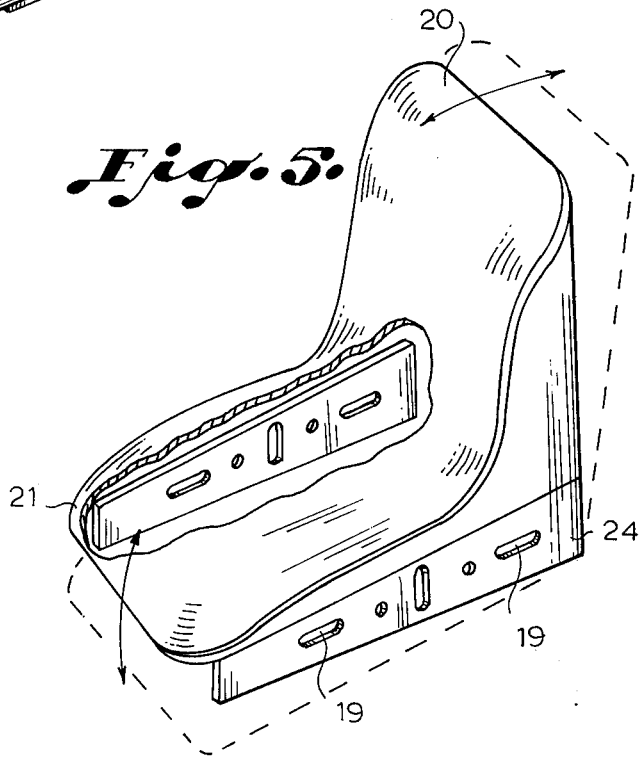
FIG. 5 is a perspective view of a chair for the lift mechanism of FIG. 4.
Figures 2, 3:
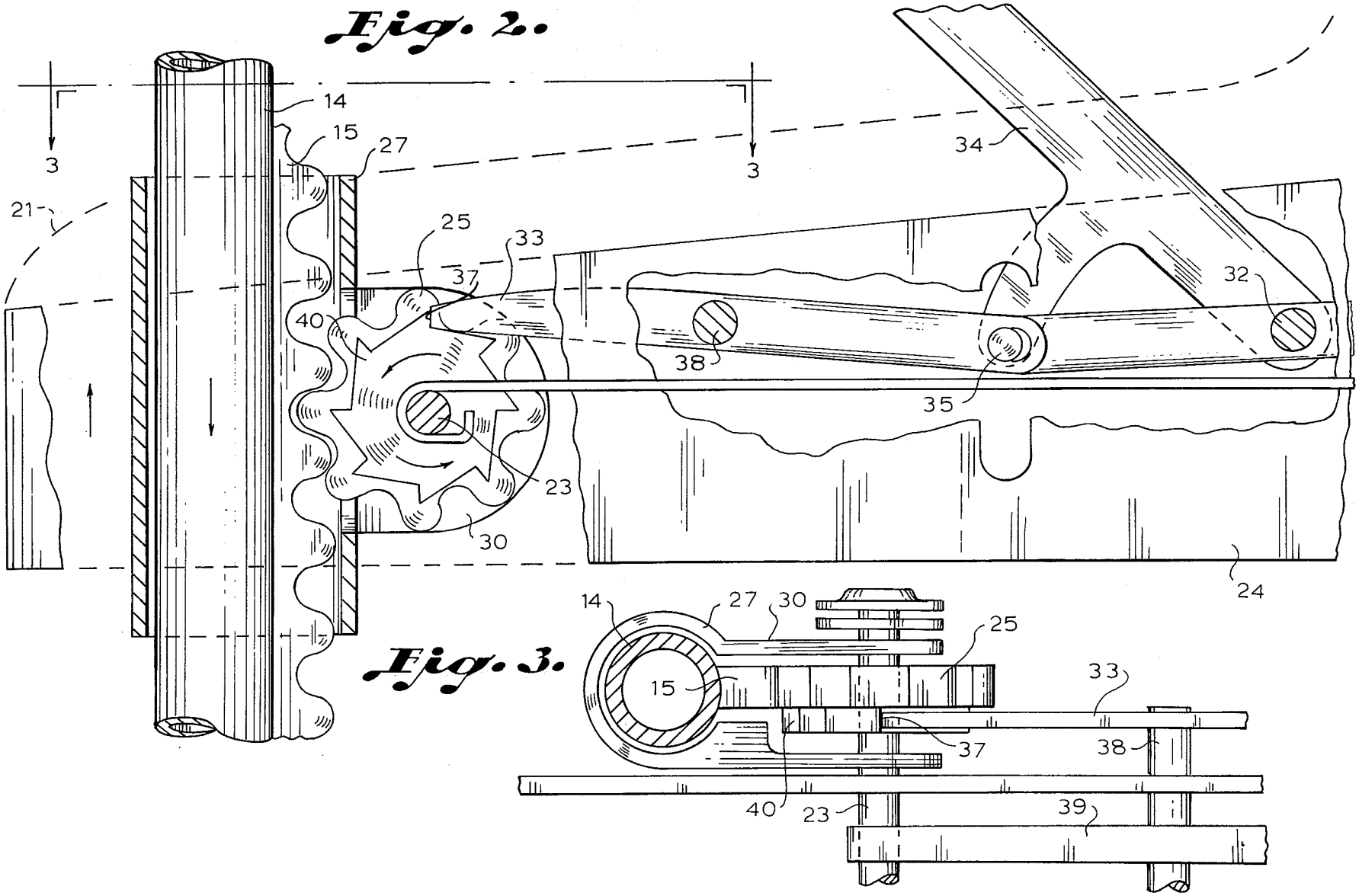
FIG. 2 is a sectional view of the lift mechanism for the chair taken on line 2—2 of FIG. 1.
FIG. 3 is a sectional view taken on the line 3—3 of FIG. 2.
Figure 4:
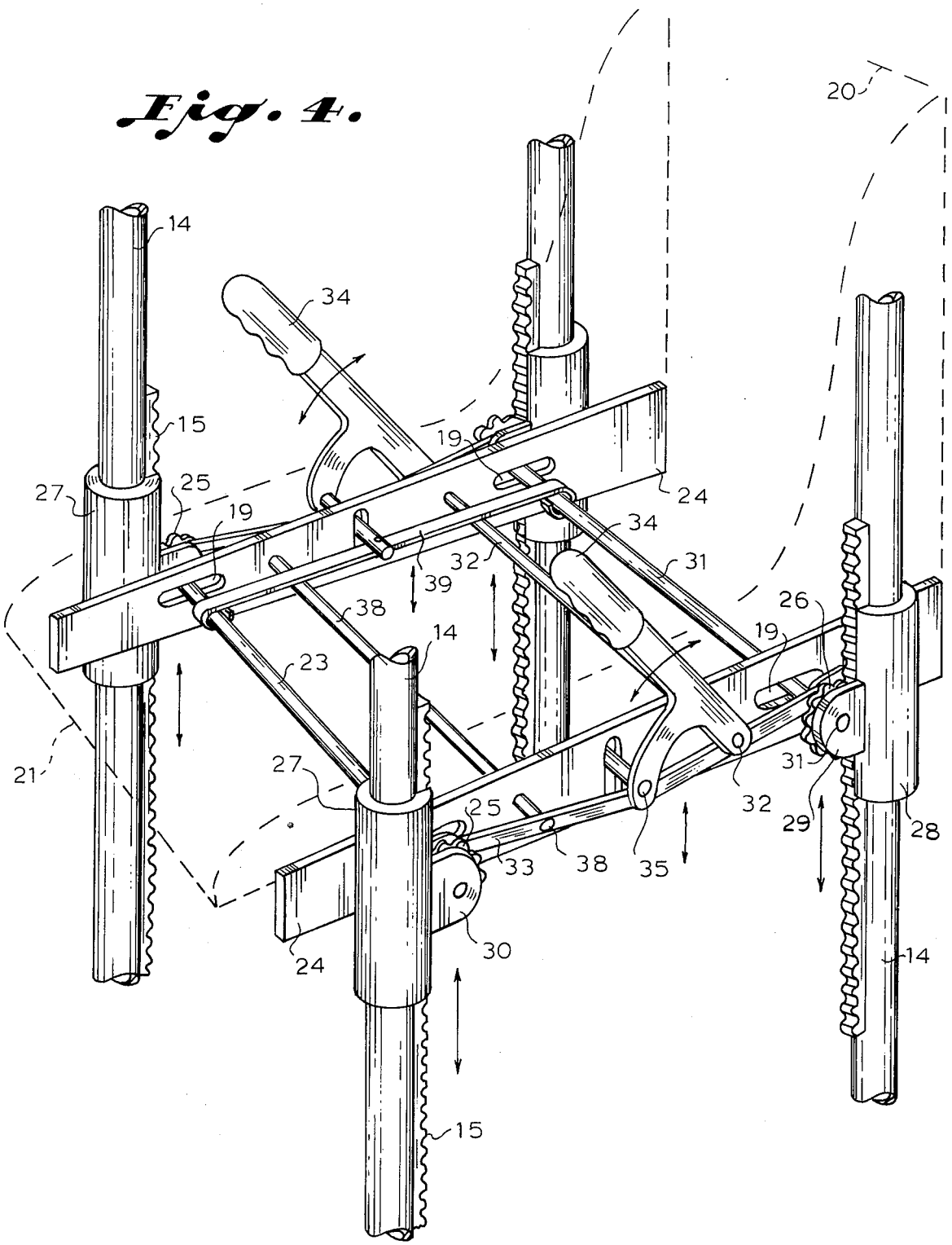
FIG. 4 is a perspective view of the lift mechanism.

Referring now to the drawings, a bathtub chair 10 is attached to a chair frame 11 having a pair of elongated base members 12 having a plurality of rubber feet 13 on the bottom thereof, and four upright or vertical frame members 14 each having a gear rack 15 formed therein. The vertical frame members 14 are fixedly attached to the base members 12 and are connected by top frame members 16 so that the members 14 and 16 form a pair of U-shaped upright frame members. The top frame members 16 have handles 17 attached thereto so that once a framework is placed in a bathtub then the handles can be used for a patient to grasp and support himself when entering and leaving a bathtub. Once in the bathtub the patient can be seated in a rockable chair 18 having a back support 20 and a patient supporting surface 21. The frame 11 also has a cross-brace member 22 for making the frame rigidly attached as one unit. In addition, front and rear shafts 23 and 31 are connected through slots 19 of base members 24 of the chair 18 for supporting the chair and are attached to front and rear cog gears 25 and 26 on either side of chair 18. The cog gears are in turn supported to front lift brackets 27 and rear lift brackets 28 which have sleeves surrounding the front and rear vertically extending frame members 14 and 15 and are attached to protruding brackets 29 and 30 on the front and rear sleeves 27 and 28. It will, of course, be clear that this mechanism for raising and lowering the chair is the same on both sides of the chair and at this point it can be seen that the cog gears 25 and 26 are connected through the chair to a similar cog gear on the opposite side of the chair so that the cog gears are synchronized and engage the teeth of the racks 15 on the vertically extending frame members 14 so that as the chair 18 is moved up and down the frame member 14, the sleeves 27 and 28 ride therewith with the cog gears 25 and 26 rotating in the racks 15. Each chair has a pair of shafts 32 and 38 attached to the base thereof which are connected to a pawl arm 33. A handle 34 is connected to the shaft 32 and to a pin 35. Pins 35 are connected to braking bands 39 so as to press on the braking bands when handles 34 are pushed forward and to release the bands when the handle is released. Pushing the handles 34 forward depresses the bands 39 pulling shafts 23 and 31 towards each other in their respective slots 19 and thereby pulling on brackets 30 and sleeves 27 and 28 and thereby pressing sleeves 27 and 28 against vertical frame members 14 to brake the descent of the chair 20. Pawl arms 32 have shaped tips 36 which enage ratchets 40 attached to cog gears 25 and 26. By having a second pair of interconnecting shafts 38 and 32, the entire lift mechanism is synchronized. The pawl arms 33 may be formed of one arm which is slightly curved and of flexible steel, or the like, and while engaging the ratchets 40 to act as a lock to hold cog gears 25 and 26 in place locked in the racks 15. However, by pushing on either or both handles 34, the pawl arms 32 are flexed to allow the ratchets 40 and cog wheels 25 and 26 to ratched downward. Pushing harder on the handles 34 will slow the descent of the chair and brake the chair to a stop.

To elevate the chair, the occupant rocks the chair back and forth exerting a pressure on the back of the chair 20. As the chair 20 rocks, it rocks frame members 24 and alternately ratchets the front and rear ratchets 40 thereby driving the chair 20 up the gear racks 15. Pivoting the chair forces each cog wheel 26 to roll on the track rear rack 15 until its ratchet engages the next notch. Repetition of this motion by rocking the chair first in one direction and then in the other gradually lifts the chair to the top of the tub side. This is a standard dual ratchet and pawl action with the ratchets being separated onto front and back upright frame members. Once the chair is lifted, the user can grasp the grips 17 and use the framework as a support for getting into and out of the bathtub.

Advantageously, this mechanism allows a simple manufacturing technique by utilizing four identical cog gears as well as four identical racks formed into vertical frame members along with identical pawl rods, handles, and grips along with a molded plastic seat. The framework can be of aluminum or steel tubing as desired and may be anodized or coated. It should be cleat at this point that other mechanisms for lifting and lowering the chair can be utilized without departing from the spirit and scope of the invention. For instance, a dual spring-loaded pawl engaging rack 15 may be actuated by a lever arm connected to the rockable chair 18 in a manner similar to some automobile jacks in which one pawl lifts the chair while the second pawl is passing to a higher rack tooth, then by lifting with the second pawl, the first pawl is pulled against a spring to the next higher rack tooth. In the present invention, front and rear racks 15 are provided but in a dual pawl system, one pawl can be placed on the front rack and the second pawl can be placed on the rear rack for raising the chair. Another anticipated alternative would be to have a large plate-type swivel base attaching frame members 14 and 15 to the base 12 to allow the entire chair and upper frame to swivel at the base and allow easy access. The chair would not swivel until the anterior edge of the chair was clear of the tub.

Accordingly, the present invention is not to be construed as limited to the particular forms as shown which are to be considered illustrative rather than restrictive.

We claim:

1. A bathtub lift chair comprising in combination:
a frame having a supporting base;
a rockable chair rockably mounted to said frame adapted to be rocked to and fro thereon; and
means for raising and lowering said rockable chair responsive to the rocking of said chair by an occupant of said chair whereby an invalid can be lowered or raised in a bathtub by the rocking of said chair.

2. The apparatus in accordance with claim 1 in which said means for raising and lowering said rockable chair includes a vertically extending rack gear means attached to said frame and forming a part thereof and means of engaging said rack gear for raising said rockable chair thereon responsive to the rocking of said chair.

3. The apparatus in accordance with claim 2 in which said means for engaging said rack are cog gears riding therein and attached to said chair and having ratchet gears attached thereto for engaging pawl arms for holding one ratchet and cog gear while a second ratchet and cog gear moves responsive to the movement of said chair.

4. The apparatus in accordance with claim 3 in which said frame has a supporting base with a plurality of feet attached thereto.

5. The apparatus in accordance with claim 4 in which said frame includes at least one handle support mounted thereto for gripping by a patient upon entering or leaving said bathtub.

6. The apparatus in accordance with claim 5 in which said frame includes a pair of elongated base members connected by a pair of transverse connecting braces.

7. The apparatus in accodance with claim 6 in which a pair of U-shaped frame members are fixedly attached to said supporting base and have supporting handles on the top portion thereof.

8. The apparatus in accordance with claim 7 in which said U-shaped frame members have a rack on each vertically extending member surrounded by a sleeve and each sleeve is connected by a shaft through said rockable chair to a second said sleeve and each said sleeve has each said ratchet and cog gear mounted thereto by said shaft.

9. The apparatus in accordance with claim 8 in which said pawl arms are connected by at least one shaft through said chair and engages each said ratchet.

10. The apparatus in accordance with claim 9 in which one said pawl arm is connected by two shafts to the pawl arm on the opposite side of said chair and has a handle attached thereto for adjusting the position of said pawl arm for releasing said ratchet and cog gears in one position and to engage at least one said ratchet and cog gear in said second position.

11. The apparatus in accordance with claim 10 in which each said pawl arm locks one ratchet when rocked in one direction while freeing a second said ratchet whereby said chair may be raised by a rocking motion repetitively locking one ratchet while freeing and lifting the other.

12. The apparatus in accordance with claim 8 in which said handle is connected to at least one braking band connecting said shafts attached to each said sleeve whereby movement of said handle will pull said shafts towards each other and said sleeves against said vertically extending frame members to brake said chair.

13. The apparatus in accordance with claim 12 in which said rockable chair has chair frame members having slots therein for slidably holding each said shaft connected to said sleeves to said rockable chair to allow said chair to rock as said shafts slide in said chair frame member slots.

* * * * *